US005275523A

United States Patent [19]

Stewart et al.

[11] Patent Number: 5,275,523

[45] Date of Patent: Jan. 4, 1994

[54] APPARATUS FOR REMOVING CIGARETTES FROM A PACKAGE THAT ENCLOSES THE SAME

[75] Inventors: Iain Stewart, Ennepetal-Voerde; Alfred Brinker, Gevelsberg, both of Fed. Rep. of Germany

[73] Assignee: Maschinenfabrik Fr. Niepmann GmbH & Co., Gevelsberg, Fed. Rep. of Germany

[21] Appl. No.: 758,840

[22] Filed: Sep. 12, 1991

[30] Foreign Application Priority Data

Sep. 12, 1990 [DE] Fed. Rep. of Germany ... 9012972[U]

[51] Int. Cl.[5] ..... A24C 5/36

[52] U.S. Cl. ..... 414/412; 414/418; 414/419; 131/96

[58] Field of Search ..... 414/404, 412, 418, 419, 414/425; 83/54, 946; 131/96

[56] References Cited

U.S. PATENT DOCUMENTS

| | | | |
|---|---|---|---|
| 2,470,236 | 5/1949 | Charlop . | |
| 3,386,320 | 6/1968 | Pinkham et al. . | |
| 3,682,341 | 8/1972 | Happel | 414/412 |
| 4,036,380 | 7/1977 | Berry et al. | 414/412 |
| 4,823,666 | 4/1989 | Galloway | 83/788 |
| 4,843,801 | 7/1989 | Roncero . | |
| 4,988,255 | 1/1991 | Hoffman | 414/418 X |
| 5,086,790 | 2/1992 | Greene, Jr. | 414/418 X |
| 5,117,843 | 6/1992 | Holmes et al. | 131/96 |

FOREIGN PATENT DOCUMENTS

| | | | |
|---|---|---|---|
| 0118289 | 9/1984 | European Pat. Off. | 414/412 |
| 2556044 | 6/1976 | Fed. Rep. of Germany | 414/412 |
| 2840999 | 4/1980 | Fed. Rep. of Germany . | |
| 0151552 | 10/1981 | Fed. Rep. of Germany | 414/404 |
| 0152642 | 6/1990 | Japan | 414/412 |

*Primary Examiner*—Michael S. Huppert
*Assistant Examiner*—Stephen Gordon
*Attorney, Agent, or Firm*—Robert W. Becker & Associates

[57] ABSTRACT

An apparatus for removing cigarettes from a package. The apparatus has at least one cutter for cutting open the package with a full cut at right angles to the lengthwise orientation of the cigarettes. The apparatus has a separating station in which the cigarettes are removed from the cut-open package prior to further processing. The separating station has two vertically oriented spaced-apart deformation faces that extend parallel to one another and are rotatable for pivoting the package out of an essentially horizontal position and into an inclined to even vertical position. The distance between the deformation faces is less than the width of the package as measured between its two narrow long sides via which the package rests against the deformation faces during the pivoting process.

23 Claims, 4 Drawing Sheets

APPARATUS FOR REMOVING CIGARETTES FROM A PACKAGE THAT ENCLOSES THE SAME

BACKGROUND OF THE INVENTION

The present invention relates to an apparatus for removing or extracting cigarettes from a package that encloses the same. The apparatus includes at least one cutting means for cutting open the package with a full cut at right angles to the orientation of the cigarettes. The apparatus also includes a separating station in which the cigarettes are removed from the cut-open package prior to further processing.

During the manufacture of cigarettes, there is frequently encountered the problem of having to reopen a large number of completely filled and packed cigarette packages or boxes. For example, this may be necessary for quality control reasons, in order to be able to use the cigarettes for subsequent tests, or because the cigarettes and/or their packages are defective.

Due to the large production quantities that are involved, the manufacture and packaging of cigarettes is ordinarily carried out completely automatically. There is therefore a need to also be able to mechanically undertake the opening of already completely packed cigarette packages that is necessary for the continuous and routine quality control processes.

Furthermore, the tobacco found in defective cigarette packages should also be conveyed for further processing. Thus, in order to recover the valuable tobacco and return it to the manufacturing process, the individual cigarettes must again be removed from the defective cigarette packages and from those that have been removed from the normal production process.

One apparatus of the aforementioned general type for removing cigarettes from a package is disclosed in U.S. Pat. No. 3,386,320, J. R. Pinkham et al. With this known apparatus, the cigarette packages are cut open by a total of three cutting blades, with the first two cuts being effected along the narrow long sides of the cigarette packages, while a third cut is carried out at right angles hereto. This further cut is undertaken as a full cut during which that portion of the cigarette package that contains the filters of the cigarettes is separated from that portion of the package that contains the valuable tobacco. The two parts that are now separated from one another are conveyed to wire mesh drums to undergo a thorough tumbling and subsequent separation of the individual constituents, for example in conformity with their different specific weight.

This known apparatus requires a total of three cutting blades disposed on different shafts in order to be able to cut the cigarette packages open far enough that they can subsequently be subjected to a separating process in tumbling drums. In addition to the increased structural expense for operating three separate cutting blades, this heretofore known apparatus has the drawback that by using tumbling drums, it is not always possible to obtain a clean separation of packaging material on the one hand and cigarettes and cigarette paper on the other hand. This known apparatus cannot reliably prevent constituents of the packaging, such as cardboard, tin foil, or wrapping foil, from passing into the tobacco during the separating process. In addition, the processing of tobacco parts in a tumbling drum together with parts of the cigarette package is very hard on the cut tobacco portions. In particular, the especially valuable long-stranded portions of the cigarette tobacco undergo an undesired reduction in size as a consequence of being processed in this manner, thereby reducing their value for further processing.

Another apparatus for removing cigarettes from packages is disclosed in U.S. Pat. No. 4,843,801, Roncero. This apparatus also operates with a total of three cutting means, although in contrast to the aforementioned U.S. Pat. No. 3,386,320, the third blade does not carry out a full cut, but rather provides only a central cut on a flat side of the cigarette package. In a subsequent station, the two halves of the flat side are raised with the aid of compressed air, and the contents of the cigarette package that are exposed in this manner are subsequently removed by pivoting. This heretofore known apparatus has a very complicated construction and has clearly limited possibilities for application. For example, this apparatus is in particular not suitable for the preliminary or simultaneous separation of cigarette filters, which must then be subsequently removed in a further separating station. In addition, the difficult cuts as well as the complicated opening process can be carried out only with packages that are in the form of hard boxes. Furthermore, it is not possible to reliably remove or expose further packaging material, such as tin foil, that is generally disposed within the cigarette boxes. This packaging material would either obstruct the complete emptying of the packages or would be emptied together with the cigarettes, which would lead to the aforementioned separation problems. To avoid the aforementioned problems, this heretofore known apparatus requires a very precise adjustment, as a result of which the apparatus is on the whole very complicated.

It is therefore an object of the present invention to provide an apparatus for removing cigarettes from packages, with the apparatus having a straightforward construction yet enabling a reliable separation between cigarettes on the one hand and the constituents of the packaging on the other hand, without thereby the danger existing that the long-stranded tobacco that is particularly valuable for a further utilization will be reduced in size.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
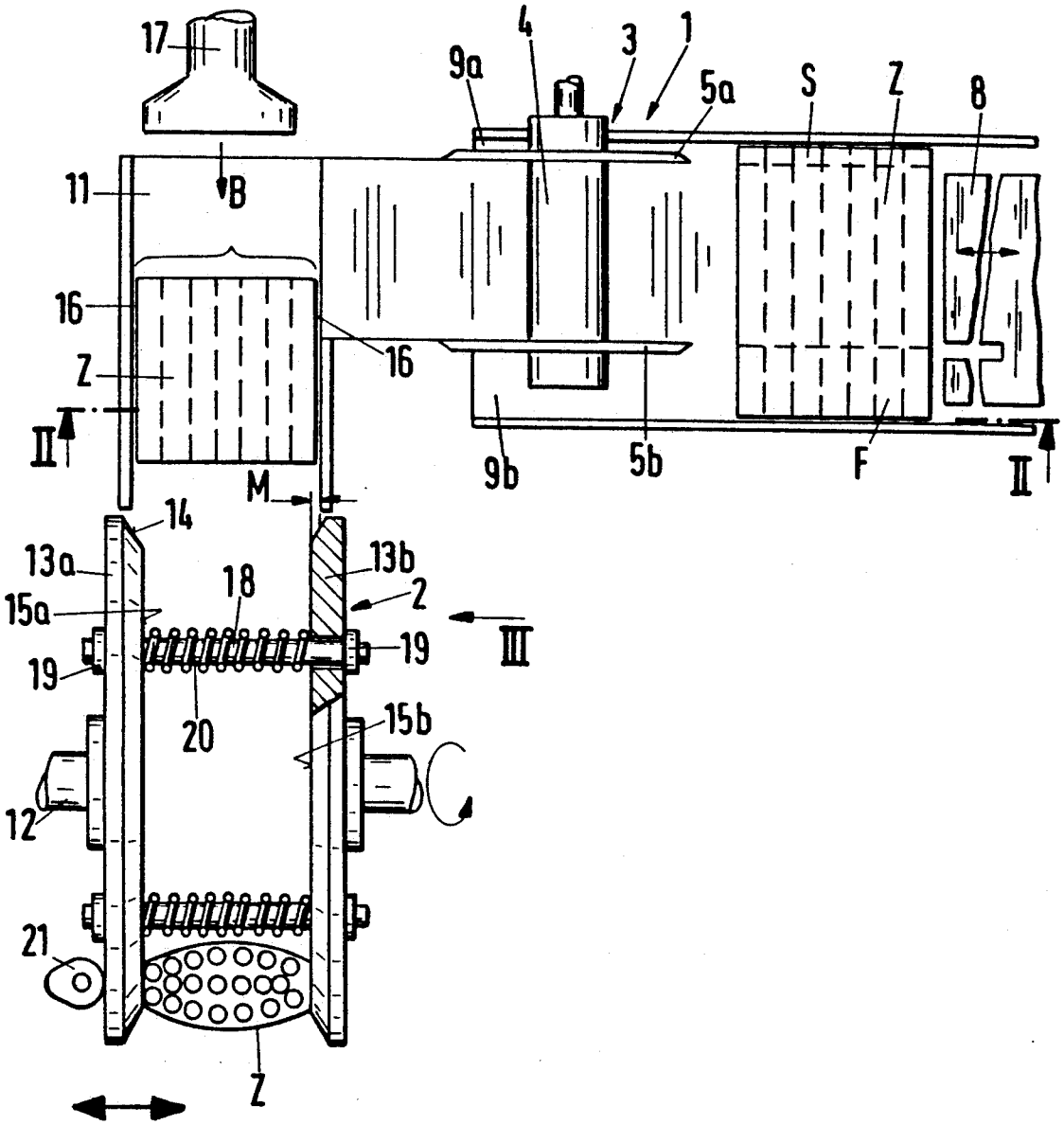
FIG. 1 is a top view of one exemplary embodiment of the inventive apparatus, and shows an unprocessed cigarette package, a further cigarette package that has already been cut open, as well as a third cigarette package that is in the emptying position.

The apparatus of the present invention is characterized primarily in that the separating station has two spaced-apart deformation faces that extend parallel to one another and are rotatable for pivoting a package out of an essentially horizontal position and into an inclined to even vertical position, with the distance between the deformation faces being less than the width of the package as measured between its two respective narrow long sides, via which the package rests against the deformation faces during the pivoting process.

Despite its straightforward construction, an apparatus constructed pursuant to the teaching of the present invention provides a reliable separation between the cigarettes on the one hand and the constituents of the packaging on the other hand. The package, which is opened via cuts along the end faces, is clamped in between the deformation faces in order to be pivoted, preferably by 90°, so that the cigarettes can slide out of the package through the open end face under the influence of the force of gravity. Due to bulging of the package between the deformation faces, the cross-sectional area of the package increases, so that the individual cigarettes can be separated and released from one another and from the inner surface of the package and can slide out of the package due to the force of gravity. Up to this point in time, i.e. until the cigarettes have been completely removed from the package, the individual tobacco strands are not subjected to any stress, so that it is possible to separate these tobacco strands from the cigarette paper in a protective and careful manner in a subsequent separating process. Of particular advantage is that the emptying of the cigarette packages can be effected after that portion of the package that contains the cigarette filters is already separated off, thereby further simplifying the subsequent separation of tobacco and cigarette paper. In this connection, the emptying of the package between the two deformation faces can be effected via the opening that results from cutting off that portion of the cigarette package that contains the cigarette filters.

Pursuant to one specific embodiment of the present invention, the deformation faces can be moved toward and away from one another in a pulsating or intermittent manner, at least at the end of the pivoting process, so that even cigarettes that are stuck in the package can fall out under the force of gravity.

The introduction of the packages between the two deformation faces is facilitated if, pursuant to another specific embodiment of the present invention the peripheral region of each of the deformation faces is provided with inclined inlet faces, with the maximum distance between the inlet faces of the two deformation faces corresponding at least to the width of the package between its respective two narrow long sides.

Pursuant to one advantageous specific embodiment of the inventive apparatus, the deformation faces are formed by the facing surfaces of two parallel deformation members or disks that are rotatably mounted on a common shaft.

Pursuant to an alternative embodiment of the inventive apparatus, the deformation faces are formed by pocket-like recessed portions on the deformation disks. These pocket-like recessed portions accommodate the narrow long sides of the packages. As a consequence, even with unstable soft cigarette packages, a reliable bulging, pivoting, and emptying of the package is possible without there being any danger that the package will slip or prematurely fall out.

The pocket-like recessed portions are preferably provided with an inclined introduction surface means. This facilitates introduction of the packages between the two deformation faces.

The bulging effect is improved if the boundary walls of the pocket-like recessed portions are inclined or chamfered, at least in the vicinity of the base thereof.

It is furthermore proposed pursuant to the present invention that the deformation faces that are formed by the pocket-like recessed portions be cyclically pivotable by a prescribed angle of rotation. This enables an exact coordination of the individual movements "introduction of the packages between the deformation faces", "pivoting", and "dropping-out of the cigarettes".

It is possible to dispose between the deformation disks compression springs as well as stop members that limit the maximum distance between the deformation disks, with these elements being disposed on cross-bars that extend through the deformation disks. In this way, it is possible to press the deformation disks together in an intermittent manner to enhance the emptying process.

To prevent the package constituents, such as the tin foil that is in the package, from being emptied with the cigarettes, it is proposed pursuant to a further specific embodiment of the inventive apparatus to provide a pin or rod that is pivotably disposed on an axis of rotation that extends parallel to the shaft of the deformation disks, with this pin being adapted to be pivoted into the cylindrical space between the deformation disks. This pin is embodied in such a way that it holds back only constituents of the cigarette package, yet does not obstruct the cigarettes themselves from falling out.

The pin is preferably disposed on the end of a lever that is pivotably mounted on the axis of rotation, with the shape of the lever, pursuant to one preferred specific embodiment, conforming to the outer contour of the deformation disks. In this way, the lever prevents the package from deflecting laterally during the pivoting process.

Preferably disposed below the lever is a flap that can be pivoted into the cylindrical space between the deformation disks and that in its pivoted-in position forms an inclined plane via which the cigarettes can slide into an available receiving container.

After emptying of the package has taken place, not only the pin that is secured to the lever but also the flap must be removed from the pivot range of the package, for which purpose the flap and the lever are preferably coupled with one another.

Feeding of the cut-open packages into the region between the deformation faces is preferably effected via a feed line by means of a pusher that is movable parallel thereto.

The emptied packages are removed from the deformation faces with the aid of a wiper or stripper that is disposed below the feed line and can be integrally embodied therewith.

The opening-up of the package is effected via two cutting means, which pursuant to a first specific embodiment are circular blades, whereas pursuant to a second embodiment a toothed compass or band saw is used. Pursuant to the first embodiment, the cutting edges of the circular blades are preferably smooth so as to enable a smooth cut that does not produce any small packaging particles, which could otherwise pass into the tobacco and thereby lower the value thereof. If a toothed compass or band saw is used as the cutting means, a suction device is disposed in the region of the cutting means to remove from the cutting region any package particles that are produced when the package is cut open.

Further specific features of the present invention will be described in detail subsequently.

DESCRIPTION OF PREFERRED EMBODIMENTS

Referring now to the drawings in detail, the apparatus illustrated in FIG. 1 for the extraction or removal of cigarettes from a package that encloses the same comprises a cutting station 1 as well as a separating station 2. The cutting station 1 has a cutting mechanism 3 that comprises a common shaft 4 and two spaced-apart blades or other appropriate cutting means 5*a*, 5*b* that are disposed on the shaft.

Figure 2:
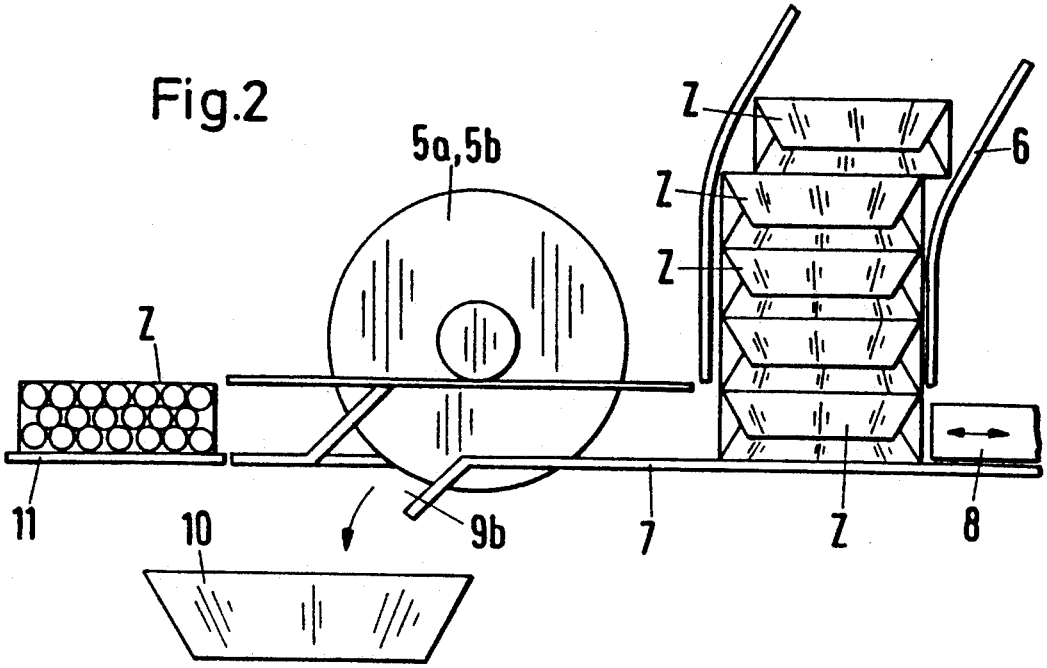
FIG. 2 is a view taken along the line II—II in FIG. 1.

As shown in FIG. 2, the cigarette packages Z that are to be emptied are fed to the cutting station 1 via a magazine 6. In this connection, the respectively lowermost cigarette package Z is disposed on a cutting table 7, via which this package is moved into the operating range of the blades 5*a*, 5*b* by means of a horizontally movable push member 8 (see FIG. 1).

As can be seen from FIG. 1, the blades 5*a*, 5*b* are disposed in such a way that each cigarette package or box Z is cut open by a total of two full cuts that are carried out at right angles to the orientation of the cigarettes. In so doing, the blade 5*b* cuts off that portion of the cigarette package Z that contains the cigarette filters F, while the other blade 5*a* cuts off the opposite end face S of the cigarette package Z. For non-filter cigarettes, or where it is not desired to cut off the filters, the blade 5*b* is set similar to the blade 5*a*, so that it cuts off the other end face of the package Z. By means of discharge chutes 9*a*, 9*b*, the portions S and F pass into a common collecting container 10, while that portion of the cigarette package that contains the tobacco is moved onto a horizontal feed line 11 that is disposed at right angles to the cutting table 7.

The stationary feed line 11 is embodied as an elongated, U-shaped sheet that extends about a shaft 12 approximately in the form of a semi-circle. The shaft 12 is a common axis of rotation for two interconnected deformation members or disks 13*a*, 13*b*, the construction of which will be described in detail subsequently.

Each of the two deformation disks 13*a*, 13*b* comprises a round plate, each of which, in the vicinity of its periphery, on that inner side thereof that faces the respective other deformation disk, is provided with an inclined inlet face 14 in the form of a flat chamfer. The facing surfaces of the deformation disks 13*a*, 13*b* form deformation faces 15*a*, 15*b*, the outer portions of which merge with the inlet face 14. The critical feature of the construction of the separating station 2 is that the spacing between the deformation faces 15*a*, 15*b* is less than the width B of the cigarette package Z between its respective two narrow long sides 16. Thus, as shown in FIG. 1, each of the deformation disks 13*a*, 13*b* has a reduction dimension M relative to the corresponding dimension of the package Z. On each side this reduction dimension M is only a few millimeters.

The transport of the package Z along the feed line 11 into the region between the two deformation disks 13*a*, 13*b* is effected via a pusher 17 that is movable parallel to the feed line 11. In this connection, the inclined inlet faces 14 facilitate the introduction of the package between the two deformation faces 15*a*, 15*b*.

Figure 3:
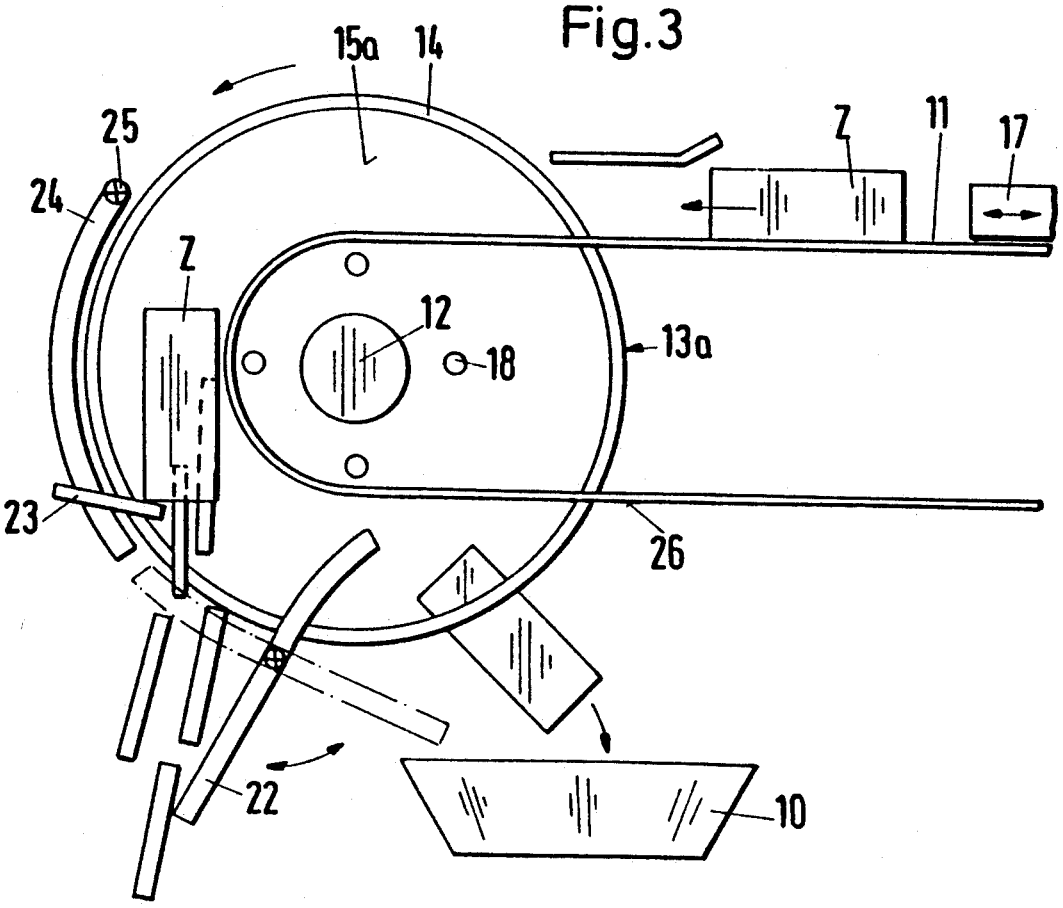
FIG. 3 is a simplified side view of the apparatus of FIG. 1 taken in the direction of the arrow III thereof.

As can be seen from FIGS. 1 and 3, the two deformation disks 13*a*, 13*b* are interconnected via a total of four parallel crossbars 18. The ends of these crossbars 18 are provided with stop members 19 that rest upon the outer surfaces of the deformation disks 13*a*, 13*b* and hence limit the maximum spacing thereof. The stop members 19 can also be adjustable, so that the spacing between the deformation disks 13*a*, 13*b* can be adjusted.

Disposed on each of the crossbars 18 is a respective compression spring 20 that rests under pressure against the two deformation faces 15*a*, 15*b* and hence presses the deformation disks 13*a*, 13*b* against the stop members 19.

Disposed on a stationary axis of rotation, in the immediate vicinity of the deformation disk 13*a*, is a cam or similar eccentric element 21 that during appropriate rotation exerts a periodic or intermittent pressure upon the outer surface of the deformation disk 13*a* and can hence impart thereto a vibrational movement.

The separating station 2 operates in the following manner. The already cut-open package Z, which is transported via the pusher 17 along the feed line 11, passes completely between the two deformation disks 13*a*, 13*b*, where it is securely held due to the friction that exists between the narrow long sides 16 of the package and the deformation faces 15*a*, 15*b*. Since the distance between the deformation faces 15*a*, 15*b* is less than the width B of the package Z, the package Z bulges in the manner illustrated in the bottom part of FIG. 1; in other words, the large or wide long sides of the package bulge convexly outward. If subsequently the deformation disks 13*a*, 13*b* are rotated by about 90°, the package Z moves into the position illustrated at the bottom of FIG. 1 and on the left side of FIG. 3, i.e. out of a horizontal position into a vertical position; in this position, the individual cigarettes slide out of the package due to the force of gravity. Due to the bulging of the package that is produced between the deformation faces 15*a*, 15*b*, the cross-sectional area of the package is increased, as a result of which the cigarettes are separated from one another and from the inside surface of the package, thereby being able to slide more easily out of the package. In order to be able to also release or separate cigarettes that might stick to the package, the deformation disks 13*a*, 13*b* are briefly pressed together by actuating the cam 21 against the force of the compression springs 20. With the aid of this vibration, even those cigarettes that are still sticking together or to the package can be dislodged. In place of the cam 21, the same effect can be achieved by using a compressed air cylinder that would then be actuated several times.

As shown in FIG. 3, a flap 22 is disposed below the deformation disks 13*a*, 13*b* so that the cigarettes that are falling out of the package can be reliably conveyed into an available receptacle. During the emptying process, the flap 22 extends into the cylindrical space between the deformation disks 13*a*, 13*b*, and after conclusion of the emptying process is pivoted out of this region so as not to obstruct further movement of the now empty package between the two deformation disks 13*a*, 13*b*.

During the emptying process, a pin or rod 23 extends beneath the open end face of the package in order to prevent parts of the package, such as tin foil, from also being emptied. Cigarettes are not prevented from falling out because the pin 23 occupies a slanted position. The pin 23 is disposed at the outer end of a lever 24, which is pivotably mounted on an axis of rotation or pivot shaft 25 that extends parallel to the shaft 12. The shape of the lever 24 conforms approximately to the outer contour of the deformation disks 13*a*, 13*b* and is therefore suitable to additionally guide the package. Prior to further transport of the emptied package via a cyclical further rotation or advancement of the deformation disks 13*a*, 13*b*, the lever 24 and the pin 23 are pivoted back. This movement is coupled with the pivoting movement of the flap 22, so that the flap 22 does not pivot the lever 24 and pin 23 back until movement of the flap 22 is at an end. This ensures that the empty package, which is in the form of a casing, cannot fall down along with the cigarettes in the event that the package becomes prematurely separated from the deformation disks 13*a*, 13*b*. The package Z is customarily released from its clamped position between the two deformation disks 13*a*, 13*b* by bumping against a stationary wiper or stripper 26 during the further transport; this wiper or stripper 26 is formed by the lower portion of the feed line 11 which is guided about the shaft 12 in a U-shaped manner. In the illustrated embodiment, the stripped packages Z pass into the same collecting container 10 into which the portions of the package that were cut off in the cutting station 1 were guided.

Figure 4:
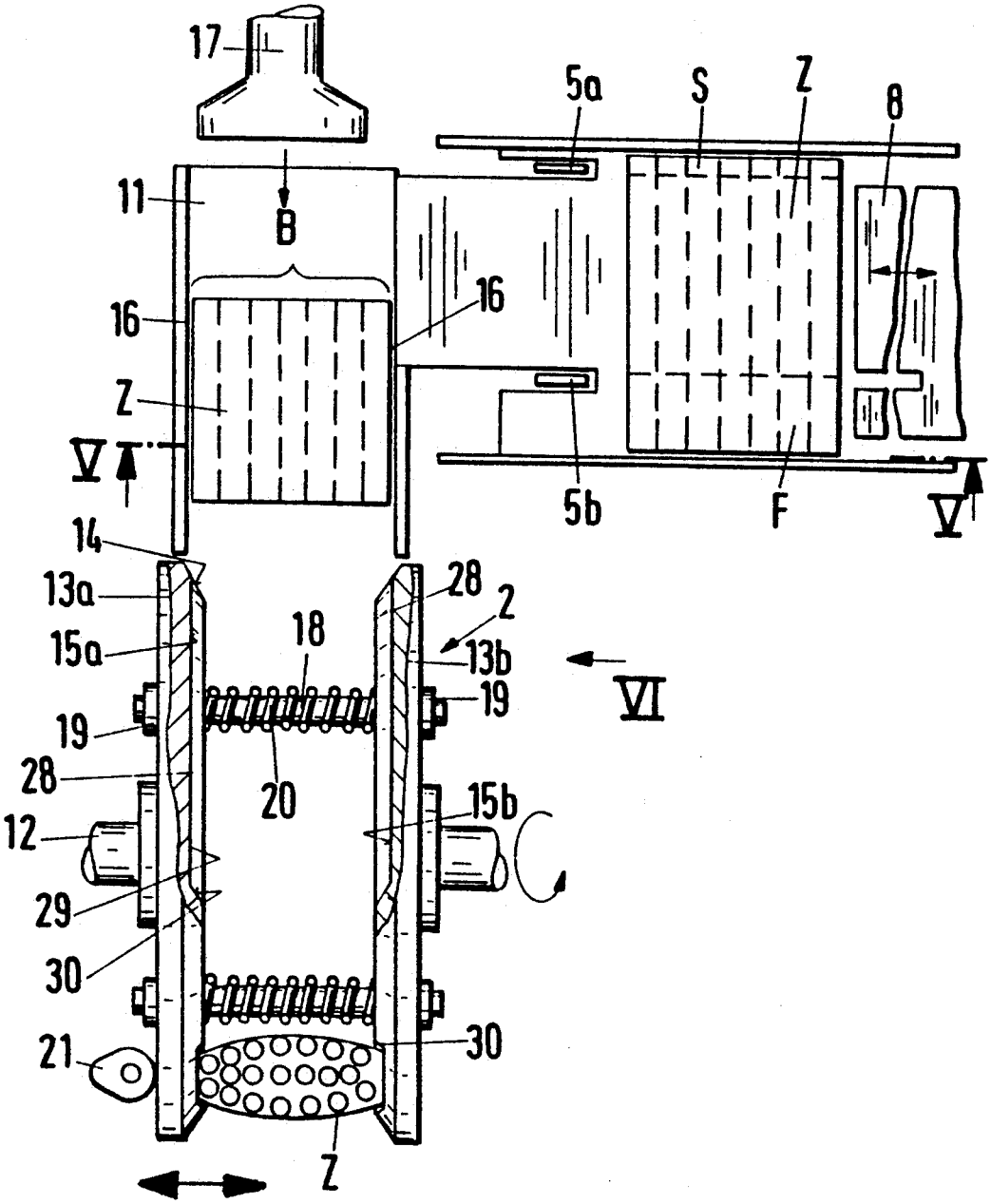
FIG. 4 is a view similar to that of FIG. 1 of a further exemplary embodiment of the inventive apparatus.
Figure 5:
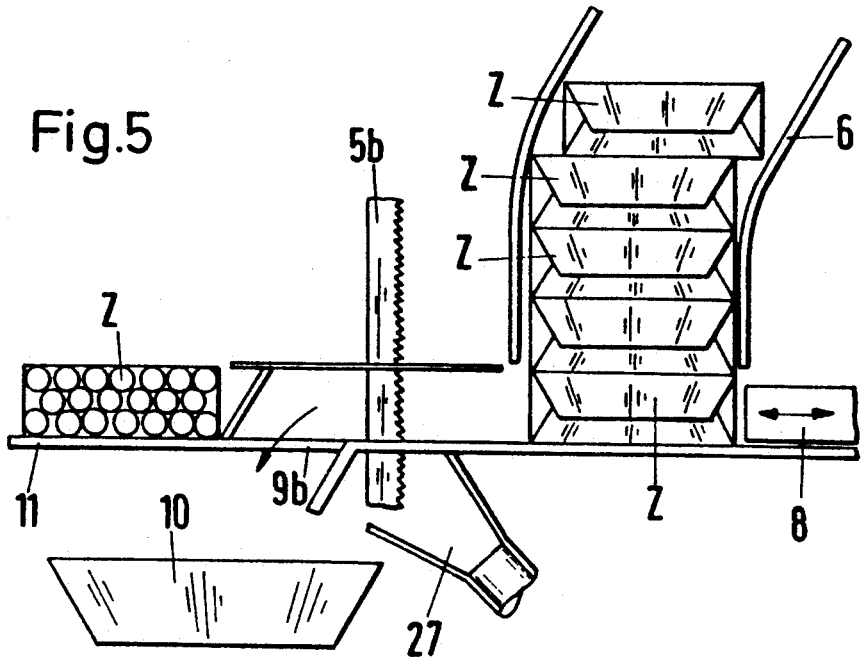
FIG. 5 is a view taken along the line V—V in FIG. 4.
Figure 6:
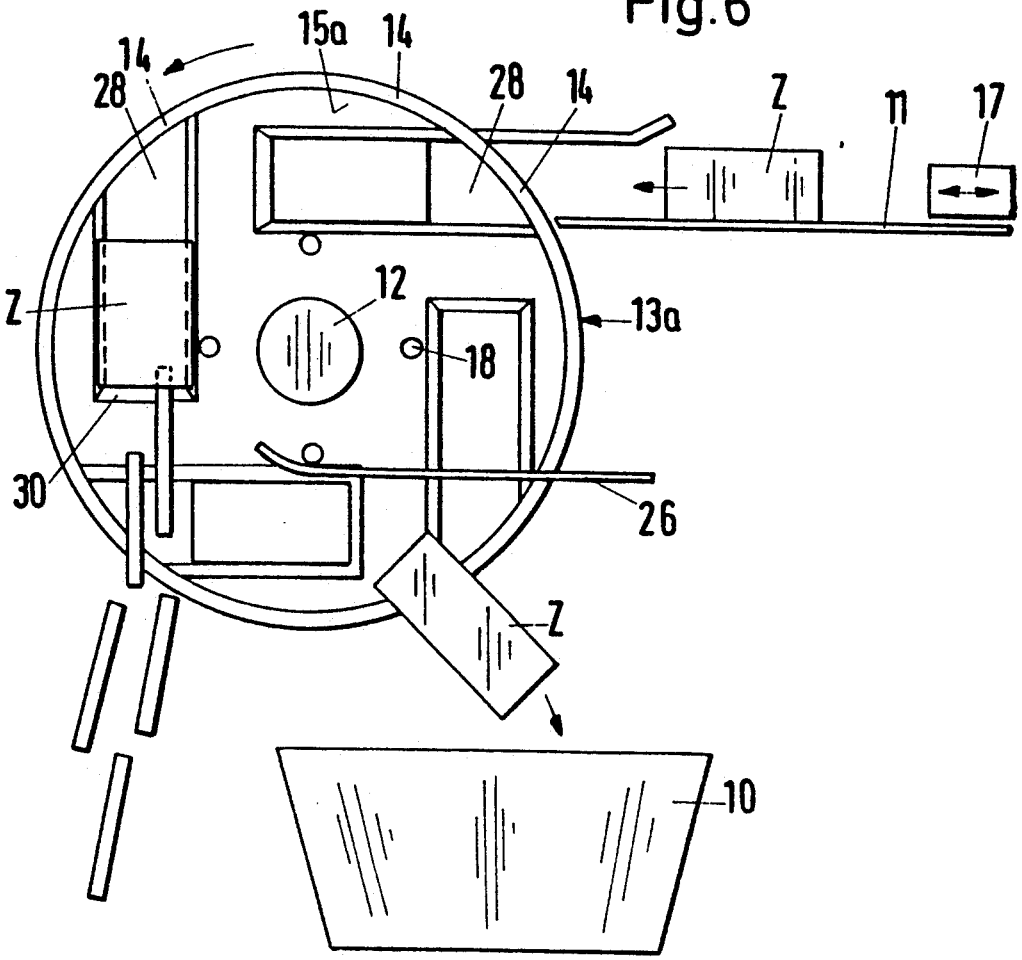
FIG. 6 is a simplified side view of the apparatus of FIG. 4 taken in the direction of the arrow VI thereof.

FIGS. 4 to 6 illustrate a modified embodiment of the inventive apparatus. Whereas in the first embodiment of FIGS. 1 to 3 the cutting means 5*a*, 5*b* were in the form of circular blades, in this embodiment the cutting means are in the form of a toothed band or compass saw. Pieces and particles of the package Z that result during the cutting process are removed from the cutting region with the aid of a suction device 27 and can therefore not pass into the tobacco.

As can be seen from FIG. 4, in this embodiment the inner sides of the deformation members or disks 13*a*, 13*b* are not planar; rather, each deformation disk is provided with four pocket-like recessed portions 28 that are offset by 90° from one another. In this connection, the deformation faces 15*a*, 15*b* are respectively formed at the bases 29 of the pocket-like recessed portions 28. The edge of the base 29 is provided with a chamfering 30. Also with this embodiment, each of the deformation faces 15*a*, 15*b* of the pocket-like recessed portions 28 is provided with an inlet face 14 that facilitates the introduction of the package Z between the two deformation faces 15*a*, 15*b*.

As can be clearly seen from FIG. 6, the pocket-like recessed portions 28, which are respectively turned relative to one another by 90°, do not extend all the way through; rather, the end face of each of these recessed portions 28 has an abutment or stop means that is formed by the chamfering 30. As a consequence of this stop means, in the position of the packages Z where they are pivoted by about 90° and the cigarettes can fall out, the packages themselves cannot fall down. As a result of this configuration, the lever 24 with the pin 23 that were required for the first embodiment of FIGS. 1 to 3 can be dispensed with in this second embodiment.

The package Z is released from its clamped position between the deformation faces 15*a*, 15*b* of the pocket-like recessed portions 28 by bumping against the stationary wiper or stripper 26 during further transport. The stripped packages Z again pass into the collecting container 10.

The present invention is, of course, in no way restricted to the specific disclosure of the specification and drawings, but also encompasses any modifications within the scope of the appended claims.

What we claim is:

1. An apparatus for removing cigarettes from a package, said apparatus including cutting means for cutting open said package with a full cut at right angles to the lengthwise orientation of said cigarettes therein, said apparatus further comprising:

a separating station in which said cigarettes are removed from said cut-open package prior to further processing, with said separating station having two vertically oriented spaced-apart deformation faces that extend parallel to one another, are formed by facing surfaces of two parallel deformation members, and are rotatably mounted on a common shaft for pivoting said package out of an essentially horizontal position and into an inclined to even vertical position, with the distance between said deformation faces being less than a width of said package as measured between two narrow long sides thereof via which said package rests against said deformation faces during a pivoting process, and wherein said separating station includes compression springs disposed between said deformation members, and stop members that delimit the maximum spacing between said deformation members.

2. An apparatus according to claim 1, which includes means for intermittently moving said deformation faces toward one another, at least at the end of a pivoting process.

3. An apparatus according to claim 1, in which a peripheral portion of each of said deformation faces is provided with inclined inlet face means, with the maximum distance between said inlet face means of said deformation faces corresponding at least to said width of said package between said two narrow long sides thereof.

4. An apparatus according to claim 1, in which said deformation faces are deformed by pocket-like recessed portions provided on said deformation members for accommodating said narrow long sides of said package.

5. An apparatus according to claim 4, in which said pocket-like recessed portions are provided with inclined introduction surface means.

6. An apparatus according to claim 5, in which boundary walls of said pocket-like recessed portions, at least in the vicinity of a base thereof, are inclined.

7. An apparatus according to claim 4, in which said deformation faces, which are formed by said pocket-like recessed portions, are cyclically pivoted through a prescribed angle of rotation.

8. An apparatus according to claim 1, which includes a plurality of crossbars that extend through said deformation members and on which are disposed not only said compression springs but also said stop members.

9. An apparatus according to claim 8, in which said crossbars pass through said compression springs.

10. An apparatus according to claim 8, in which said stop members are adjustable.

11. An apparatus according to claim 1, which includes a pin that is pivotable about an axis of rotation that extends parallel to said common shaft, with said pin being pivotable into a cylindrical space formed between said deformation members.

12. An apparatus according to claim 11, in which said pin is secured to an end of a lever that is pivotable about said axis of rotation.

13. An apparatus according to claim 12, in which said lever has a shape that conforms to an outer contour of said deformation members.

14. An apparatus according to claim 12, which includes a flap that is pivotably mounted below said lever to pivot into said space between said deformation members and in such position form an inclined plane.

15. An apparatus according to claim 1, which includes an approximately horizontal feed line for cut-open packages, with said feed line extending into a region between said deformation faces.

16. An apparatus according to claim 15, which includes a pusher that is movable parallel to said feed line for transporting cut-open packages.

17. An apparatus according to claim 16, which includes a stripper that is fixedly disposed between said deformation faces below said feed line.

18. An apparatus according to claim 1, in which said cutting means comprises two cutters, one for cutting off one end face of said package, and another for cutting off the opposite end face of said package, including that portion thereof that contains the filters of filter cigarettes.

19. An apparatus according to claim 18, in which said cutters are circular blades.

20. An apparatus according to claim 19, in which said circular blades have smooth cutting edges.

21. An apparatus according to claim 19, in which said circular blades have toothed cutting edges.

22. An apparatus according to claim 18, in which said cutters are toothed compass or band saws.

23. An apparatus according to claim 22, which includes a suction device disposed in the vicinity of said cutters.

* * * * *